US011377623B2

(12) United States Patent
Araki et al.

(10) Patent No.: US 11,377,623 B2
(45) Date of Patent: Jul. 5, 2022

(54) SURFACTANT AND DETERGENT CONTAINING SURFACTANT

(71) Applicant: SANYO CHEMICAL INDUSTRIES, LTD., Kyoto (JP)

(72) Inventors: Yusuke Araki, Kyoto (JP); Yoshiyuki Wakahara, Kyoto (JP)

(73) Assignee: SANYO CHEMICAL INDUSTRIES, LTD., Kyoto (JP)

( * ) Notice: Subject to any disclaimer, the term of this patent is extended or adjusted under 35 U.S.C. 154(b) by 151 days.

(21) Appl. No.: 16/766,443

(22) PCT Filed: Nov. 12, 2018

(86) PCT No.: PCT/JP2018/041793

§ 371 (c)(1),
(2) Date: May 22, 2020

(87) PCT Pub. No.: WO2019/107127

PCT Pub. Date: Jun. 6, 2019

(65) Prior Publication Data

US 2021/0032566 A1 Feb. 4, 2021

(30) Foreign Application Priority Data

Nov. 29, 2017 (JP) ..... JP2017-228693

(51) Int. Cl.
*C11D 1/72* (2006.01)
*C11D 1/722* (2006.01)
*C11D 1/825* (2006.01)

(52) U.S. Cl.
CPC ..... *C11D 1/72* (2013.01)

(58) Field of Classification Search
CPC ..... C11D 1/72; C11D 1/722; C11D 1/825; C11D 3/3707
See application file for complete search history.

(56) References Cited

U.S. PATENT DOCUMENTS

| | | | | |
|---|---|---|---|---|
| 5,346,973 | A * | 9/1994 | Feustel | B01F 17/0092 510/422 |
| 6,682,749 | B1 | 1/2004 | Potechin et al. | |
| 9,301,908 | B2 | 4/2016 | Toda et al. | |
| 10,881,758 | B2 * | 1/2021 | Sekifuji | D04H 1/435 |
| 2003/0027729 | A1 | 2/2003 | Kaimai et al. | |
| 2007/0103526 | A1 * | 5/2007 | Fukuda | C09D 11/38 347/100 |
| 2008/0176997 | A1 * | 7/2008 | Fernandez | C11D 1/8255 525/50 |
| 2011/0160393 | A1 | 6/2011 | Sakamoto et al. | |
| 2018/0000979 | A1 * | 1/2018 | Sekifuji | D04H 1/435 |

FOREIGN PATENT DOCUMENTS

| | | | | |
|---|---|---|---|---|
| CN | 1948605 | 4/2007 | | |
| CN | 101033582 | 9/2007 | | |
| CN | 101235138 | 8/2008 | | |
| CN | 102149747 | 8/2011 | | |
| EP | 0970690 | 1/2000 | | |
| EP | 2 438 963 | 4/2012 | | |
| JP | 48-20200 | 6/1973 | | |
| JP | 4-73271 | 3/1992 | | |
| JP | 4-82961 | 3/1992 | | |
| JP | 4-240266 | 8/1992 | | |
| JP | 7-126690 | 5/1995 | | |
| JP | 11-152683 | 6/1999 | | |
| JP | 2000-265371 | 9/2000 | | |
| JP | 2001-288682 | 10/2001 | | |
| JP | 2002-88651 | 3/2002 | | |
| JP | 2002-114844 | 4/2002 | | |
| JP | 2004-91686 | 3/2004 | | |
| JP | 2004-324025 | 11/2004 | | |
| JP | 2006-96704 | 4/2006 | | |
| JP | 2007-107131 | 4/2007 | | |
| JP | 2008-081600 | 4/2008 | | |
| JP | 2008-88063 | 4/2008 | | |
| JP | 2008-208323 | 9/2008 | | |
| JP | 2010-506720 | 3/2010 | | |
| JP | 4429000 | 3/2010 | | |
| JP | 2011-21138 | 2/2011 | | |
| JP | 4778925 | 9/2011 | | |
| JP | 2012-102424 | 5/2012 | | |
| JP | 2014-079561 | 5/2014 | | |
| JP | 2016-211065 | 12/2016 | | |
| JP | 2017-80643 | 5/2017 | | |
| JP | 2017-145241 | 8/2017 | | |
| WO | 2005/033222 | 4/2005 | | |
| WO | 2008/051389 | 5/2008 | | |
| WO | 2011/052113 | 5/2011 | | |
| WO | WO 2016/121673 | * 8/2016 | | D06M 15/53 |

OTHER PUBLICATIONS

International Search Report dated Dec. 11, 2018 in International (PCT) Application No. PCT/JP2018/041793.
"Surfactant and detergent chemistry and Technology", China Light Industry Press, 1997, pp. 391, with Concise Explanation.
International Search Report dated Apr. 19, 2016 in International (PCT) Application No. PCT/JP2016/051967, which corresponds with U.S. Pat. No. 10,881,758.
Agricultural products Organic Chemical Industry, Apr. 1979.

* cited by examiner

*Primary Examiner* — Brian P Mruk

(74) *Attorney, Agent, or Firm* — Wenderoth, Lind & Ponack, L.L.P.

(57) ABSTRACT

A surfactant (a) having a critical micelle concentration (CMC) of 0.10 g/L or lower, represented by formula (1): $R^1$—[—O-($A^1O$)$_n$—H]$_m$ (1), wherein $R^1$ is a C7-C20 hydrocarbon group having a valence number of m; m is an integer of 2 to 6; $A^1$ in ($A^1O$)$_n$ in each of [—O-($A^1O$)$_n$—H]$_m$ is each independently a C2-C4 alkylene group; n in [—O-($A^1O$)$_n$—H]$_m$ is each independently an integer of 1 to 100; and the sum of n in [—O-($A^1O$)$_n$—H]$_m$ is 13 or greater.

4 Claims, No Drawings

SURFACTANT AND DETERGENT CONTAINING SURFACTANT

TECHNICAL FIELD

The present invention relates to a surfactant and a detergent containing a surfactant.

BACKGROUND ART

Conventionally, surfactants obtained by addition polymerization of an alkylene oxide to a higher alcohol and surfactants obtained by addition polymerization of an alkylene oxide to an aliphatic amine exhibit excellent surface active properties and have been widely used in a wide range of applications. In recent years, however, there is concern that surfactants such as detergents may adversely affect the environment and ecosystem when they are used in fields that require consideration for the environment and ecosystem. Thus, surfactants that exhibit excellent detergency even in small amounts are required.

Various polyoxyalkylene alkyl ethers have been proposed as conventional surfactants obtained by addition polymerization of an alkylene oxide to a higher alcohol. Examples thereof include an adduct of an ethylene oxide with an aliphatic alcohol as a starting material, an adduct of an alkylene oxide with an aliphatic alcohol obtained by block addition of an ethylene oxide, then a propylene oxide, and then an ethylene oxide to an aliphatic alcohol (Patent Literature 1), and an adduct of an alkylene oxide with an aliphatic alcohol obtained by random addition of a mixture of an ethylene oxide and a propylene oxide to an aliphatic alcohol, followed by block addition of an ethylene oxide (Patent Literature 2).

Various polyoxyalkylene alkylamines have been proposed as surfactants obtained by addition polymerization of an alkylene oxide to an alkylamine (Patent Literatures 3 and 4).

However, the polyoxyalkylene alkyl ether described in Patent Literature 1 and 2 has insufficient detergency when used in low concentration. The polyoxyalkylene alkylamine described in Patent Literature 3 and 4 has excellent detergency when used alone in low concentration, while when the polyoxyalkylene alkylamine is used in combination with an anionic surfactant which is widely used as a detergent, it forms a complex through bonds between the amine groups and the anion groups. Thus, detergency is reduced. Polyoxyalkylene alkylamine also has a problem of poor biodegradability.

CITATION LIST

Patent Literature

Patent Literature 1: JP 2011-021138 A
Patent Literature 2: JP H07-126690 A
Patent Literature 3: JP 4429000 B
Patent Literature 4: JP 4778925 B

SUMMARY OF INVENTION

Technical Problem

The present invention aims to provide a surfactant that has excellent detergency even when used in low concentration and exhibits excellent detergency even when used in combination with an anionic surfactant.

Solution to Problem

As a result of examination for achieving the above problem, the present inventors have reached the present invention.

That is, the present invention relates to a surfactant (a) having a critical micelle concentration (CMC) of 0.10 g/L or lower, represented by the formula (1):

$$R^1—[—O-(A^1O)_n—H]_m \quad (1)$$

wherein $R^1$ is a C7-C20 hydrocarbon group having a valence number of m; m is an integer of 2 to 6; $A^1$ in $(A^1O)_n$ in each of $[—O-(A^1O)_n—H]_m$ is each independently a C2-C4 alkylene group; n in $[—O-(A^1O)_n—H]_m$ is each independently an integer of 1 to 100; and the sum of n in $[—O-(A^1O)_n—H]_m$ is 13 or greater. The present invention also relates to a detergent containing the surfactant (a).

Advantageous Effects of Invention

A surfactant of the present invention has an effect of having excellent detergency even when used in low concentration and exhibits excellent detergency even when used in combination with an anionic surfactant.

DESCRIPTION OF EMBODIMENTS

The surfactant (a) of the present invention is represented by the above formula (1).

In the formula (1), $R^1$ is a C7-C20 hydrocarbon group having a valence number of m.

Examples of the C7-C20 hydrocarbon group having a valence number of m include a residue obtained by removing m hydroxy groups from a C7-C20 polyol.

Examples of the C7-C20 polyol include a C7-C20 saturated polyol and a C7-C20 unsaturated polyol.

Preferred examples of the C7-C20 saturated polyol include a C7-C20 acyclic saturated aliphatic polyol, such as heptanediol, octanediol, nonanediol, decanediol, undecanediol, dodecanediol, tridecanediol, tetradecanediol, pentadecanediol, hexadecanediol, heptadecanediol, octadecanediol, nonadecanediol, icosanediol, 2,2-diethyl-1,3-propanediol, or 1,2,10-decanetriol.

Preferred examples of the C7-C20 unsaturated polyol include a C7-C20 acyclic unsaturated aliphatic polyol, such as heptenediol, octenediol, decenediol, or icosenediol.

Among the C7-C20 polyols, alcohols (e.g., 1,2-dodecanediol) in which at least one of carbon atoms to which hydroxy groups are bonded is a tertiary carbon atom are preferred from the viewpoint of detergency.

In the C7-C20 hydrocarbon groups having a valence number of m, a C7-C20 alkylene group (a residue obtained by removing two hydroxy groups from a C7-C20 acyclic saturated aliphatic diol) is preferable from the viewpoint of detergency, and a C10-C16 alkylene group (a residue obtained by removing two hydroxy groups from a C10-C16 acyclic saturated aliphatic diol) is more preferable.

In the formula (1), the number of the secondary carbon atoms in the carbon atoms in $R^1$ which are bonded to oxygen atoms in $[—O-(A^1O)_n—H]_m$ is preferably 1 or more, more preferably 1 from the viewpoint of detergency.

In the formula (1), n in $[—O-(A^1O)_n—H]_m$ is each independently an integer of 1 to 100.

Further, m is an integer of 2 to 6, and from the viewpoint of detergency, m is preferably an integer of 2.

The sum of n in $[—O-(A^1O)_n—H]_m$ (which corresponds to the number of moles of a C2-C4 alkylene oxide added to a C7-C20 polyol in the method of producing the surfactant (a) detailed below) is 13 or greater.

When the sum of n in $[—O-(A^1O)_n—H]_m$ is less than 13, detergency deteriorates.

The sum of n in $[—O-(A^1O)_n—H]_m$ is preferably 15 to 100, particularly preferably 30 to 70 for further increasing the detergency.

In the formula (1), $A^1$ in $(A^1O)_n$ in each of $[—O-(A^1O)_n—H]_m$ is each independently a C2-C4 alkylene group.

Examples of the C2-C4 alkylene group include an ethylene group, a 1,2- or 1,3-propylene group, and a 1,2-, 1,3-, 1,4-, or 2,3-butylene group.

From the viewpoint of detergency, $A^1$ is preferably a combination of at least one selected from the group consisting of a 1,2-propylene group, a 1,2-butylene group, a 1,3-butylene group, and a 2,3-butylene group with an ethylene group.

The surfactant (a) has a critical micelle concentration (CMC) of 0.10 g/L or lower.

When the surfactant (a) has a CMC of higher than 0.10 g/L, detergency deteriorates. In particular, the detergency of the below-described detergent when used in low concentration deteriorates.

In particular, in order to provide the below-described detergent having further enhanced detergency when used in low concentration, the CMC of the surfactant (a) is preferably 0.08 g/L or lower.

The CMC of the surfactant (a) can be measured by the surface tension method described below.

The surface tensions (mN/m) of aqueous solutions having optional concentrations of the surfactant (a) are measured at 25° C. by a pendant drop method. The concentrations (g/L) of the surfactant (a) in the aqueous solutions are allocated to the horizontal axis and the surface tensions (mN/m) are allocated to the vertical axis to draw a graph of a surface tension-concentration curve. The CMC (unit: g/L) can be determined from the curve.

The measurement of surface tension by a pendant drop method can use a fully automatic interfacial tensiometer PD-W (Kyowa Interface Science Co., Ltd.).

The surfactant (a) preferably has a hydrophile-lipophile balance (HLB) value of 11 to 17, more preferably of 13 to 15 from the viewpoint of detergency.

The HLB value is a scale indicating hydrophilicity and hydrophobicity. The HLB value herein is calculated by Oda method, not by the Griffin's method. The Oda method refers to a method described, for example, in "Introduction to Surfactants" (Kaimenkasseizai nyumon) (Fujimoto Takehiko (2007), Sanyo Chemical Industries, Ltd.) (see page 212).

The HLB value can be determined from a ratio between a value of organic nature and a value of inorganic nature shown in the table on page 213 of "Introduction to Surfactants".

$$HLB \cong 10 \times \text{inorganic nature/organic nature}$$

The surfactant (a) of the present invention may be produced by a known method such as a method of adding a C2-C4 alkylene oxide, (e.g., an ethylene oxide, a 1,2- or 1,3-propylene oxide, and a 1,2-, 1,3-, 1,4-, or 2,3-butylene oxide) to a C7-C20 polyol.

It is empirically known that in non-ionic surfactants, CMC increases as the number of moles of ethylene oxide added corresponding to the C2-C4 alkylene oxide increases, (see L. Hsiao, H. N. Dunning, P. B. Lorenz, J. Phys. Chem., 60, 657 (1956)).

Although the surfactant (a) of the present invention is a nonionic surfactant, the CMC thereof can be sufficiently reduced by adding a relatively large number of moles (specifically, 13 mol or more) of a C2-C4 alkylene oxide to a C7-C20 polyol. Thus, the CMC can be controlled within the above-described range.

In order to sufficiently reduce the CMC, the C7-C20 polyol is preferably any of the C7-C20 polyols listed for $R^1$ as preferred examples.

When the surfactant (a) of the present invention is present in the below-described detergent, the detergent has excellent detergency when used in low concentration and exhibits excellent detergency even when used in combination with an anionic surfactant which is widely used as a detergent. Thus, the surfactant (a) is useful for detergents, particularly for laundry detergents.

A detergent of the present invention contains the surfactant (a). The surfactant (a) may be used alone or two or more surfactants (a) may be used in combination.

When the detergent of the present invention contains two or more surfactants (a), the weighted average CMC (g/L) of the surfactants (a) each corresponding to the surfactant (a) based on the weight ratio of these surfactants (a) is 0.10 g/L or lower. In order to provide a detergent having further enhanced detergency when used in low concentration, the weighted average CMC (g/L) is preferably 0.08 g/L or lower.

When the detergent of the present invention contains two or more surfactants (a), the weighted average HLB value of the surfactants (a) each corresponding to the surfactant (a) based on the weight ratio of these the surfactants (a) is preferably 11 to 17, more preferably 13 to 15 from the viewpoint of detergency.

In order to further increase the detergency, the detergent of the present invention preferably further contains a surfactant (b) represented by the following formula (2) other than the surfactant (a).

$$R^2—X-(A^2O)_p—H \quad (2)$$

In the formula (2), $R^2$ is a C10-C18 monovalent hydrocarbon group.

Examples of the C10-C18 monovalent hydrocarbon group include a C10-C18 acyclic monovalent aliphatic hydrocarbon group such as a C10-C18 acyclic monovalent saturated aliphatic hydrocarbon group (e.g., a decyl group, a lauryl group, a myristyl group, a palmityl group, or a stearyl group) or a C10-C18 acyclic monovalent unsaturated aliphatic hydrocarbon group (e.g., a decenyl group, a dodecenyl group, or an oleyl group); a C10-C18 monovalent alicyclic hydrocarbon group (e.g., a cyclodecyl group or a cyclododecyl group); and a C10-C18 monovalent aromatic hydrocarbon group (e.g., a naphthalene group or an anthracene group).

In the formula (2), X is —COO— or —O—.

In the formula (2), $A^2$ is each independently a C2-C4 alkylene group.

In the formula (2), p is an integer of 1 to 30.

When the detergent of the present invention contains the surfactant (a) having two or more polyoxyalkylene chains in one molecule and the surfactant (b) having one polyoxyalkylene chain in one molecule in combination, the detergent can have dramatically enhanced detergency, particularly when used in low concentration.

The surfactant (b) may be used alone or two or more surfactants (b) may be used in combination.

The surfactant (b) in the present invention can be obtained by a known method by adding a C2-C4 alkylene oxide (e.g., ethylene oxide, propylene oxide, or butylene oxide) to an alcohol in which a C10-C18 monovalent hydrocarbon group and a hydroxy group are bonded or a carboxylic acid in which a C10-C18 monovalent hydrocarbon group and a carboxy group are bonded.

When the detergent of the present invention further contains the surfactant (b), the average HLB value of the surfactant (a) and the surfactant (b) (the weighted average HLB value of the surfactant (a) each corresponding to the surfactant (a) and the surfactant (b) each corresponding the surfactant (b) based on the weight ratio of the surfactant (a) and the surfactant (b)) is preferably 12 to 15.

When the average HLB value is in the range of the above preferred values, the detergency can be further enhanced.

The detergent of the present invention may further contain an anionic surfactant (c) other than the surfactant (a) and the surfactant (b).

Examples of the anionic surfactant (c) include sulfonates, sulfates, and alkyl fatty acid salts. From the viewpoint of detergency, a C10-C100 anionic surfactant is preferred, and a C10-C25 anionic surfactant is more preferred.

Examples of the sulfonates include a sodium linear alkylbenzene sulfonate, such as sodium dodecylbenzenesulfonate or sodium tetradecylbenzenesulfonate.

Examples of the sulfates include sodium lauryl sulfate and sodium polyoxyethylene lauryl ether sulfate.

Examples of the alkyl fatty acid salts include a lauric acid monoethanolamine salt and a lauric acid diethanolamine salt.

The anionic surfactant (c) may be used alone or two or more of the anionic surfactants (c) may be used in combination.

The detergent of the present invention may further contain other components such as a solvent (e.g., water, ethanol, isopropanol, ethylene glycol, propylene glycol, or glycerol), an anti-soil redeposition agent (e.g., sodium polyacrylate, polyethylene glycol, or carboxymethyl cellulose), a fluorescent brightening agent (e.g., an oxazole compound, a coumalin compound, a stilbene compound, an imidazole compound, or a triazole compound), a pigment, a perfume, an antimicrobial antiseptic agent, a defoamer (e.g., silicone), a pH adjuster (e.g., sodium carbonate, sodium silicate, or citric acid), a chelating agent (e.g., citric acid, sodium edetate, or sodium etidronate), and an enzyme (e.g., cellulase, protease, or lipase).

The proportion by weight of the surfactant (a) in the detergent of the present invention is preferably 1 to 70% by weight, more preferably 5 to 50% by weight, particularly preferably 10 to 30% by weight based on the weight of the detergent from the viewpoint of detergency and prevention of gelation or caking when the surfactant (a) is blended.

The weight ratio of the surfactant (b) to the surfactant (a) ((b)/(a)) in the detergent of the present invention is preferably 0 to 10, more preferably 0.17 to 5.7, particularly preferably 0.20 to 5.5, most preferably 0.25 to 4.0 from the viewpoint of detergency.

The weight ratio of the anionic surfactant (c) to the surfactant (a) ((c)/(a)) in the detergent of the present invention is preferably 0 to 10, more preferably 0.25 to 4 from the viewpoint of detergency.

The detergent of the present invention can be produced by the selected method as described below.

Specifically, in the case of a liquid detergent, the detergent may be produced, for example, as follows: a mixing vessel equipped with a stirrer and a heating/cooling device is charged with the surfactant (a), the surfactant (b), the anionic surfactant (c), and other components in any order, and the contents are stirred at 10° C. to 50° C. until they become uniform.

The detergent of the present invention has excellent detergency even when used in low concentration, exhibits excellent detergency even when containing an anionic surfactant which is widely used as a detergent, and is useful particularly for laundry detergents.

EXAMPLES

The present invention is described in more detail below with reference to examples, but the present invention is not limited thereto.

Hereafter, "part(s)" indicates "part(s) by weight".

Example 1: Production of Surfactant. (a1)

A 2-L autoclave equipped with a stirrer, a thermometer, a pressure gauge, a drop type pressure cylinder, a pressure reducing line, and a nitrogen introducing line was charged with 202 parts (1 part by mol) of 1,2-dodecanediol and 1.4 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and a mixture of 1410 parts (32 parts by mol) of ethylene oxide and 697 parts (12 parts by mol) of 1,2-propylene oxide was sequentially added dropwise at a pressure of 0.3 MPaG or lower over eight hours. The contents were stirred at the same temperature for one hour until the pressure reached equilibrium. Subsequently, 440 parts (10 parts by mol) of ethylene oxide was sequentially added dropwise over three hours, and the contents were stirred at the same temperature for one hour until the pressure reached equilibrium. Thereafter, the contents were cooled to 60° C. and neutralized with 1.0 part of acetic acid. Thus, a surfactant (a1) was obtained.

Example 2: Production of Surfactant (a2)

A 2-L autoclave equipped with a stirrer, a thermometer, a pressure gauge, a drop type pressure cylinder, a pressure reducing line, and a nitrogen introducing line was charged with 202 parts (1 part by mol) of 1,2-dodecanediol and 0.43 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and 661 parts (15 parts by mol) of ethylene oxide was sequentially added dropwise at a pressure of 0.3 MPaG or lower over five hours. The contents were stirred at the same temperature for one hour until the pressure reached equilibrium. Thereafter, the contents were cooled to 60° C. and neutralized with 0.32 parts of acetic acid. Thus, a surfactant (a2) was obtained.

Example 3: Production of Surfactant (a3)

A 2-L autoclave equipped with a stirrer, a thermometer, a pressure gauge, a drop type pressure cylinder, a pressure reducing line, and a nitrogen introducing line was charged with 202 parts (1 part by mol) of 1,2-dodecanediol and 0.64 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and 837 parts (19 parts by mol) of ethylene oxide was sequentially added dropwise at a pressure of 0.3 MPaG or lower over six hours. The contents were stirred at the same temperature for one hour until the pressure reached equilibrium. Subsequently, 232 parts (4 parts by mol) of 1,2-propylene oxide was sequentially added dropwise over three hours, and the contents were stirred at the same temperature for one hour until the pressure reached equilibrium. Thereafter, the contents were cooled to 60° C. and neutralized with 0.48 parts of acetic acid. Thus, a surfactant (a3) was obtained.

Example 4: Production of Surfactant (a4)

A 2-L autoclave equipped with a stirrer, a thermometer, a pressure gauge, a drop type pressure cylinder, a pressure reducing line, and a nitrogen introducing line was charged with 258 parts (1 part by mol) of 1,2-hexadecanediol and 0.43 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and 881 parts (20 parts by mol) of ethylene oxide was sequentially added dropwise at a pressure of 0.3 MPaG or lower over five hours. The contents were stirred at the same temperature for one hour until the pressure reached equilibrium. Thereafter, the contents were cooled to 60° C. and neutralized with 0.32 part of acetic acid. Thus, a surfactant (a4) was obtained.

Example 5: Production of Surfactant (a5)

A 2-L autoclave equipped with a stirrer, a thermometer, a pressure gauge, a drop type pressure cylinder, a pressure reducing line, and a nitrogen introducing line was charged with 230 parts (1 part by mol) of 1,2-tetradecanediol and 1.4 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and a mixture of 3305 parts (75 parts by mol) of ethylene oxide and 1452 parts (25 parts by mol) of 1,2-propylene oxide was sequentially added dropwise at a pressure of 0.3 MPaG or lower over eight hours. The contents were stirred at the same temperature for one hour until the pressure reached equilibrium. Thereafter, the contents were cooled to 60° C. and neutralized with 1.0 part of acetic acid. Thus, a surfactant (a5) was obtained.

Example 6: Production of Surfactant (a6)

A 2-L autoclave equipped with a stirrer, a thermometer, a pressure gauge, a drop type pressure cylinder, a pressure reducing line, and a nitrogen introducing line was charged with 174 parts (1 part by mol) of 1,2-decanediol and 0.43 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and 661 parts (15 parts by mol) of ethylene oxide was sequentially added dropwise at a pressure of 0.3 MPaG or lower over five hours. The contents were stirred at the same temperature for one hour until the pressure reached equilibrium. Thereafter, the contents were cooled to 60° C. and neutralized with 0.32 parts of acetic acid. Thus, a surfactant (a6) was obtained.

Example 7: Production of Surfactant (a7)

A 2-L autoclave equipped with a stirrer, a thermometer, a pressure gauge, a drop type pressure cylinder, a pressure reducing line, and a nitrogen introducing line was charged with 202 parts (1 part by mol) of 1,2-dodecanediol and 1.4 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and a mixture of 748 parts (17 parts by mol) of ethylene oxide and 406 parts (7 parts by mol) of 1,2-propylene oxide was sequentially added dropwise at a pressure of 0.3 MPaG or lower over eight hours. The contents were stirred at the same temperature for one hour until the pressure reached equilibrium. Subsequently, 440 parts (10 parts by mol) of ethylene oxide was sequentially added dropwise over three hours, and the contents were stirred at the same temperature for one hour until the pressure reached equilibrium. Thereafter, the contents were cooled to 60° C. and neutralized with 1.0 part of acetic acid. Thus, a surfactant (a7) was obtained.

Example 8: Production of Surfactant (a8)

A 2-L autoclave equipped with a stirrer, a thermometer, a pressure gauge, a drop type pressure cylinder, a pressure reducing line, and a nitrogen introducing line was charged with 202 parts (1 part by mol) of 1,2-dodecanediol and 1.4 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and a mixture of 1760 parts (40 parts by mol) of ethylene oxide and 870 parts (15 parts by mol) of 1,2-propylene oxide was sequentially added dropwise at a pressure of 0.3 MPaG or lower over eight hours. The contents were stirred at the same temperature for one hour until the pressure reached equilibrium. Subsequently, 440 parts (10 parts by mol) of ethylene oxide was sequentially added dropwise over three hours, and the contents were stirred at the same temperature for one hour until the pressure reached equilibrium. Thereafter, the contents were cooled to 60° C. and neutralized with 1.0 part of acetic acid. Thus, a surfactant (a8) was obtained.

Comparative Example 1: Production of Comparative Surfactant (a'1)

A 2-L autoclave equipped with a stirrer, a thermometer, a pressure gauge, a drop type pressure cylinder, a pressure reducing line, and a nitrogen introducing line was charged with 202 parts (1 part by mol) of 1,2-dodecanediol and 0.43 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and 176 parts (4 parts by mol) of ethylene oxide was sequentially added dropwise at a pressure of 0.3 MPaG or lower over five hours. The contents were stirred at the same temperature for one hour until the pressure reached equilibrium. Thereafter, the contents were cooled to 60° C. and neutralized with 0.32 parts of acetic acid. Thus, a comparative surfactant (a'1) was obtained.

Comparative Example 2: Production of Comparative Surfactant (a'2)

A 2-L autoclave equipped with a stirrer, a thermometer, a pressure gauge, a drop type pressure cylinder, a pressure reducing line, and a nitrogen introducing line was charged with 76 parts (1 part by mol) of propylene glycol and 0.43 parts of potassium hydroxide. Stirring was started, the autoclave was charged with nitrogen, and the temperature was increased to 90° C., followed by dehydration at a pressure of −0.1 MPaG for one hour. Subsequently, the temperature was increased to 160° C., and 661 parts (15 parts by mol) of ethylene oxide was sequentially added dropwise at a pressure of 0.3 MPaG or lower over five hours. The contents were stirred at the same temperature for one hour until the pressure reached equilibrium. Thereafter, the contents were cooled to 60° C. and neutralized with 0.32 parts of acetic acid. Thus, a comparative surfactant (a'2) was obtained.

Comparative Example 3: Production of Comparative Surfactant (a'3)

A 2-L autoclave equipped with a stirrer, a thermometer, a pressure gauge, a drop type pressure cylinder, a pressure reducing line, and a nitrogen introducing line was charged with 144 parts (1 part by mol) of 1,4-cyclohexanedimethanol and 0.43 parts of potassium hydroxide. Stirring was started, the autoclave was charged with nitrogen, and the temperature was increased to 90° C., followed by dehydration at a pressure of −0.1 MPaG for one hour. Subsequently, the temperature was increased to 160° C., and 881 parts (20 parts by mol) of ethylene oxide was sequentially added dropwise at a pressure of 0.3 MPaG or lower over five hours. The contents were stirred at the same temperature for one hour until the pressure reached equilibrium. Thereafter, the contents were cooled to 60° C. and neutralized with 0.32 parts of acetic acid. Thus, a comparative surfactant (a'3) was obtained.

The surfactants (a1) to (a8) obtained in Examples 1 to 8 and the comparative surfactants (a'1) to (a'3) obtained in Comparative Examples 1 to 3 were evaluated for CMC by the following surface tension method. The results are shown in Table 1.

The surface tensions (mN/m) of aqueous solutions having optional concentrations of the surfactant (a) were measured at 25° C. by a pendant drop method. The concentrations (g/L) of the surfactant (a) were allocated to the horizontal axis and the surface tensions were allocated to the vertical axis to draw a graph. On the graph were plotted changes of the surface tensions (25° C.) relative to the concentrations of the surfactant (a). Thereby, a surface tension-concentration curve was obtained. The CMC (unit: g/L) was determined from the curve.

A fully automatic interfacial tensiometer PD-W (Kyowa Interface Science Co., Ltd.) was used for the measurement of surface tension by a pendant drop method.

The case where no CMC can be determined in the aqueous solutions having a surfactant (a) concentration of 0.30 g/L or lower in the surface tension method was indicated by "0.30<".

Production Example 1: Production of Surfactant (b1)

A 2-L autoclave equipped with a stirrer, a thermometer, a pressure gauge, a drop type pressure cylinder, a pressure reducing line, and a nitrogen introducing line was charged with 186 parts (1 part by mol) of lauryl alcohol and 0.29 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and 396 parts (9 parts by mol) of ethylene oxide was sequentially added dropwise at a pressure of 0.3 MPaG or lower over five hours. The contents were stirred at the same temperature for one hour until the pressure reached equilibrium. Thereafter, the contents were cooled to 60° C. and neutralized with 0.22 parts of acetic acid. Thus, a surfactant (b1) was obtained.

Production Example 2: Production of Surfactant (b2)

A 2-L autoclave equipped with a stirrer, a thermometer, a pressure gauge, a drop type pressure cylinder, a pressure reducing line, and a nitrogen introducing line was charged with 214 parts (1 part by mol) of myristyl alcohol and 0.61 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and 836 parts (19 parts by mol) of ethylene oxide was sequentially added dropwise at a pressure of 0.3 MPaG or lower over six hours. The contents were stirred at the same temperature for one hour until the pressure reached equilibrium. Subsequently, 174 parts (3 parts by mol) of 1,2-propylene oxide was sequentially added dropwise over three hours, and the contents were stirred at the same temperature for one hour until the pressure reached equilibrium. Thereafter, the contents were cooled to 60° C. and neutralized with 0.46 parts of acetic acid. Thus, a surfactant (b2) was obtained.

Production Example 3: Production of Surfactant (b3)

A 2-L autoclave equipped with a stirrer, a thermometer, a pressure gauge, a drop type pressure cylinder, a pressure reducing line, and a nitrogen introducing line was charged with 214 parts (1 part by mol) of myristyl alcohol and 0.41 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and a mixture of 220 parts (5 parts by mol) of ethylene oxide and 174 parts (3 parts by mol) of 1,2-propylene oxide was sequentially added dropwise at a pressure of 0.3 MPaG or lower over five hours. The contents were stirred at the same temperature for one hour until the pressure reached equilibrium. Subsequently, 220 parts (5 parts by mol) of ethylene oxide was sequentially added dropwise over three hours, and the contents were stirred at the same temperature for one hour until the pressure reached equilibrium. Thereafter, the contents were cooled to 60° C. and neutralized with 0.31 parts of acetic acid. Thus, a surfactant (b3) was obtained.

Production Example 4: Production of Surfactant (b4)

A 2-L autoclave equipped with a stirrer, a thermometer, a pressure gauge, a drop type pressure cylinder, a pressure reducing line, and a nitrogen introducing line was charged with 200 parts (1 part by mol) of lauric acid and 0.30 parts of potassium hydroxide. Stirring was started, the autoclave was charged with nitrogen, and the temperature was increased to 130° C., followed by dehydration at a pressure of −0.1 MPaG for one hour. Subsequently, the temperature was increased to 160° C., and 396 parts (9 parts by mol) of ethylene oxide was sequentially added dropwise at a pressure of 0.3 MPaG or lower over five hours. The contents were stirred at the same temperature for one hour until the pressure reached equilibrium. Thereafter, the contents were cooled to 60° C. and neutralized with 0.22 parts of acetic acid. Thus, a surfactant (b4) was obtained.

Examples 9 to 26 and Comparative Examples 4 to 12

Each of the surfactants shown in Table 1 was added in an amount (parts) according to Table 1 and the materials are uniformly mixed to obtain detergents of Examples 9 to 26 and comparative detergents of Comparative Examples 4 to 12.

The following describes the materials used in Table 1.

Sodium linear alkylbenzene sulfonate: trade name "TAYCAPOWER LN2450", Tayca Corporation Coconut oil fatty acid sorbitan: trade name "IONET S-20", Sanyo Chemical Industries, Ltd.

Polyoxyethylene coconut oil fatty acid sorbitan: trade name "IONET T-20-C", Sanyo Chemical Industries, Ltd., number of oxyethylene groups in one molecule: 20

In Table 1, EO is an ethyleneoxy group, and PO is a propyleneoxy group.

The symbol "/" represents random bonding between EO and PO, and the symbol "-" represents block bonding between EO and PO.

The resulting detergents of Examples 9 to 26 and the resulting comparative detergents of Comparative Examples 4 to 12 were evaluated for detergency and fluidity by the following methods.

<Detergency Test>

A detergency test used artificially contaminated wet cloth (Laundry Science Association (Sentaku Kagaku Kyokai)). Ten artificially contaminated wet clothes were put into a wash solution (a liquid prepared by diluting a detergent with water to a concentration of 0.2 g/L) according to Table 1. They were washed and rinsed using a tergotometer (Daiei Kagaku Seiki Mfg. Co., Ltd.) under the conditions described below. Thereafter, the cloths were taken out and dried using a geer oven: GPS-222 (Espec Corp.) at 50° C. for 60 minutes. Thus, test cloths after detergent test were obtained.

Subsequently, the reflectance at 540 nm of each of the test cloths before detergency test (artificially contaminated wet cloths), the test cloths after detergency test, and standard white cloths (clean cloths available from Laundry Science Association (Sentaku Kagaku Kyokai)) was measured using a spectroscopic colorimeter (SpectroPhotometer SD5000 available from Nippon Denshoku Industries Co., Ltd.). The measurement was performed at two points (one on each surface) in each test cloth (20 points in total for each set of 10 test cloths). The results were averaged, and the average was used to calculate the detergency rate (%) by the following equation. A higher detergency rate indicates better detergency.

This test was performed under the conditions where the concentration of the detergent was low (concentration of detergent in wash solution: 0.2 g/L).

(Washing Conditions)

Duration: 10 minutes, temperature: 25° C., revolution: 100 rpm (Rinsing Conditions)

Duration: one minute, temperature: 25° C., revolution: 100 rpm $$\text{Detergency rate (\%)}=((R_W-R_S)/(R_I-R_S))\times 100 \quad \text{(Equation)}$$

In the equation, $R_I$ is the reflectance of each standard white cloth, $R_W$ is the reflectance of each washed test cloth, and $R_S$ is the reflectance of each unwashed test cloth.

<Fluidity Test>

Each detergent was put into a transparent glass bottle and was allowed to stand in a thermostatic bath at 4° C. for 24 hours. Thereafter, the glass bottle was tilted and visually observed at 4° C., and evaluated according to the following criteria.

Good: When the glass bottle was tilted, fluidity was observed.

Poor: When the glass bottle was tilted, no fluidity was observed.

TABLE 1

| | | | | | | | Example | | | | | | | | | | | | | |
|---|---|---|---|---|---|---|---|---|---|---|---|---|---|---|---|---|---|---|---|---|
| | | | | | | | 9 | 10 | 11 | 12 | 13 | 14 | 15 | 16 | 17 | 18 | 19 | 20 | 21 | 22 |
| Formulation (parts by weight) | Surfactant (a) | Example 1 | Adduct (al) of (EO32/PO12)-EO10 (mol) with 1,2-dodecanediol | Sum of n in $[—O—(A^1O)_n—H]_m$: 54 | CMC (g/L): 0.044 | HLB value: 14.3 | 20 | | | 10 | 10 | 3 | 17 | 10 | 10 | 10 | | | | |
| | | Example 2 | Adduct (a2) of EO15 (mol) with 1,2-dodecanediol | Sum of n in $[—O—(A^1O)_n—H]_m$: 15 | CMC (g/L): 0.073 | HLB value: 16.0 | | 20 | | | | | | | | | 10 | | | |
| | | Example 3 | Adduct (a3) of EO19-PO4 (mol) with 1,2-dodecanediol | Sum of n in $[—O—(A^1O)_n—H]_m$: 23 | CMC (g/L): 0.055 | HLB value: 14.3 | | | 20 | | | | | | | | | 10 | | |
| | | Example 4 | Adduct (a4) of EO20 (mol) with 1,2-hexadecanediol | Sum of n in $[—O—(A^1O)_n—H]_m$: 20 | CMC (g/L): 0.080 | HLB value: 15.3 | | | | | | | | | | | | | 20 | |
| | | Example 5 | Adduct (a5) of (EO75/PO25) (mol) with 1,2-tetradecanediol | Sum of n in $[—O—(A^1O)_n—H]_m$: 100 | CMC (g/L): 0.070 | HLB value: 14.0 | | | | | | | | | | | | | | 20 |
| | | Example 6 | Adduct (a6) of EO15 (mol) with 1,2-decanediol | Sum of n in $[—O—(A^1O)_n—H]_m$: 15 | CMC (g/L): 0.065 | HLB value: 16.8 | | | | | | | | | | | | | | |
| | | Example 7 | Adduct (a7) of (EO17/PO7)-EO10 (mol) with 1,2-decanediol | Sum of n in $[—O—(A^1O)_n—H]_m$: 34 | CMC (g/L): 0.051 | HLB value: 14.3 | | | | | | | | | | | | | | |
| | | Example 8 | Adduct (a8) of (EO40/PO15)-EO10 (mol) with 1,2-decanediol | Sum of n in $[—O—(A^1O)_n—H]_m$: 65 | CMC (g/L): 0.046 | HLB value: 14.3 | | | | | | | | | | | | | | |
| | Surfactant (a') | Comparative Example 1 | Adduct (a'1) of EO4 (mol) with 1,2-decanediol | Sum of n in $[—O—(A^1O)—H]_m$: 4 | CMC (g/L): 0.140 | HLB value: 12.8 | | | | | | | | | | | | | | |
| | | Comparative Example 2 | Adduct (a'2) of EO15 (mol) with propylene glycol | Sum of n in $[—O—(A^1O)_n—H]_m$: 15 | CMC (g/L): 0.30< | HLB value: 20.4 | | | | | | | | | | | | | | |
| | | Comparative Example 3 | Adduct (a'3) of EO20 (mol) with 1,4-cyclohexanemethanol | Sum of n in $[—O—(A^1O)_n—H]_m$: 20 | CMC (g/L): 0.30< | HLB value: 18.1 | | | | | | | | | | | | | | |
| | Surfactant (b) | Production Example 1 | Adduct (b1) of EO9 (mol) with lauryl alcohol | | | HLB value: 12.9 | | | | 10 | | | | | | | | | | |
| | | Production | Adduct (b2) of EO19-PO3 (mol) with myristyl alcohol | | | HLB value: 13.3 | | | | | 10 | 17 | 3 | 10 | | | 10 | 10 | | |

TABLE 1-continued

| | | | | | | | | | | | | | | | | | | | | |
|---|---|---|---|---|---|---|---|---|---|---|---|---|---|---|---|---|---|---|---|---|
| | | Example 2 Production | Adduct (b3) of (EO5/PO3)-EO5 (mol) with myristyl alcohol | | | HLB value: 11.0 | | | | | | | | | 10 | | | | | |
| | | Example 3 Production | Adduct (b4) of EO9 (mol) with lauric acid | | | HLB value: 12.3 | | | | | | | | | | 10 | | | | |
| | Anionic surfactant (c) | Example 4 Sodium linear alkylbenzene sulfonate | | | | | 10 | 10 | 10 | 10 | 10 | 10 | 10 | | 10 | 10 | 10 | 10 | 10 | 10 |
| | Other surfactant | Coconut oil fatty acid sorbitan<br>Polyoxyethylene coconut oil fatty acid sorbitan | | | | | | | | | | | | | | | | | | |
| | Water | | | | | | 70 | 70 | 70 | 70 | 70 | 70 | 70 | 80 | 70 | 70 | 70 | 70 | 70 | 70 |
| | Total | | | | | | 100 | 100 | 100 | 100 | 100 | 100 | 100 | 100 | 100 | 100 | 100 | 100 | 100 | 100 |
| Detergency test | Wash solution [g/L] | | | | | | 0.2 | 0.2 | 0.2 | 0.2 | 0.2 | 0.2 | 0.2 | 0.2 | 0.2 | 0.2 | 0.2 | 0.2 | 0.2 | 0.2 |
| | Detergency rate (%) | | | | | | 27 | 23 | 23 | 30 | 35 | 30 | 32 | 35 | 30 | 30 | 26 | 28 | 23 | 23 |
| | Fluidity | | | | | | Good | Good | Good | Good | Good | Good | Good | Good | Good | Good | Good | Good | Good | Good |

| | | | | | | | Example | | | | Comparative Example | | | | | | | | |
|---|---|---|---|---|---|---|---|---|---|---|---|---|---|---|---|---|---|---|---|
| | | | | | | | 23 | 24 | 25 | 26 | 4 | 5 | 6 | 7 | 8 | 9 | 10 | 11 | 12 |
| Formulation (parts by weight) | Surfactant (a) | Example 1 | Adduct (a1) of (EO32/PO12)-EO10 (mol) with 1,2-dodecanediol | Sum of n in $[—O—(A^1O)_n—H]_m$: 54 | CMC (g/L): 0.044 | HLB value: 14.3 | | | | 20 | | | | | | | | | |
| | | Example 2 | Adduct (a2) of EO15 (mol) with 1,2-dodecanediol | Sum of n in $[—O—(A^1O)_n—H]_m$: 15 | CMC (g/L): 0.073 | HLB value: 16.0 | | | | | | | | | | | | | |
| | | Example 3 | Adduct (a3) of EO19-PO4 (mol) with 1.2-dodecanediol | Sum of n in $[—O—(A^1O)_n—H]_m$: 23 | CMC (g/L): 0.055 | HLB value: 14.3 | | | | | | | | | | | | | |
| | | Example 4 | Adduct (a4) of EO20 (mol) with 1,2-hexadecanediol | Sum of n in $[—O—(A^1O)_n—H]_m$: 20 | CMC (g/L): 0.080 | HLB value: 15.3 | | | | | | | | | | | | | |
| | | Example 5 | Adduct (a5) of (EO75/PO25) (mol) with 1,2-tetradecanediol | Sum of n in $[—O—(A^1O)_n—H]_m$: 100 | CMC (g/L): 0.070 | HL value | | | | | | | | | | | | | |
| | | Example 6 | Adduct (a6) of EO15 (mol) with 1,2-decanediol | Sum of n in $[—O—(A^1O)_n—H]_m$: 15 | CMC (g/L): 0.065 | HLB value: 16.8 | 20 | | | | | | | | | | | | |
| | | Example 7 | Adduct (a7) of (EO17/PO7)-EO10 (mol) with 1,2-decanediol | Sum of n in $[—O—(A^1O)_n—H]_m$: 34 | CMC (g/L): 0.051 | HLB value: 14.3 | | 20 | | | | | | | | | | | |
| | | Example 8 | Adduct (a8) of (EO40/PO15)-EO10 (mol) with 1,2-dodecanediol | Sum of n in $[—O—(A^1O)_n—H]_m$: 65 | CMC (g/L): 0.046 | HLB value: 14.3 | | | 20 | | | | | | | | | | |

TABLE 1-continued

| | | | | | | | | | | | | | | | | | |
|---|---|---|---|---|---|---|---|---|---|---|---|---|---|---|---|---|---|
| | Surfactant (a') | Comparative Example 1 | Adduct (a'1) of EO4 (mol) with 1,2-decanediol | Sum of n in $[—O—(A^1O)— H]_m$: 4 | CMC (g/L): 0.140 | HLB value: 12.8 | | | | | | | | | | 20 | | |
| | | Comparative Example 2 | Adduct (a'2) of EO15 (mol) with propylene glycol | Sum of n in $[—O—(A^1O)_n—H]_m$: 15 | CMC (g/L): 0.30< | HLB value: 20.4 | | | | | | | | | | | 20 | |
| | | Comparative Example 3 | Adduct (a'3) of EO20 (mol) with 1,4-cyclohexanedimethanol | Sum of n in $[—O—(A^1O)_n—H]_m$: 20 | CMC (g/L): 0.30< | HLB value: 18.1 | | | | | | | | | | | | 20 |
| | Surfactant (b) | Production Example 1 | Adduct (b1) of EO9 (mol) with lauryl alcohol | | | HLB value: 12.9 | | | | 20 | | | | | | 20 | | |
| | | Production Example 2 | Adduct (b2) of EO19-PO3 (mol) with myristyl alcohol | | | HL value: 13.3 | | | | | 20 | | | | | | 20 | 20 |
| | | Production Example 3 | Adduct (b3) of (EO5/PO3)-EO5 (mol) with myristyl alcohol | | | HL value: 11.0 | | | | | | 20 | | | | | | |
| | | Production Example 4 | Adduct (b4) of EO9 (mol) with lauric acid | | | HL value: 12.3 | | | | | | | 20 | | | | | |
| | Anionic Surfactant (c) | Sodium linear alkylbenzene sulfonate | | | | | 10 | 10 | 10 | 10 | 10 | 10 | 10 | 10 | 10 | 10 | 10 | 10 |
| | Other Surfactant | Coconut oil fatty acid sorbitan Polyoxyethylene coconut oil fatty acid sorbitan | | | | | | | | | | | | 20 | 20 | | | |
| | Water | | | | | | 70 | 70 | 70 | 80 | 70 | 70 | 70 | 70 | 70 | 70 | 70 | 70 |
| | Total | | | | | | 100 | 100 | 100 | 100 | 100 | 100 | 100 | 100 | 100 | 100 | 100 | 100 |
| Detergency test | Wash solution [g/L] | | | | | | 0.2 | 0.2 | 0.2 | 0.2 | 0.2 | 0.2 | 0.2 | 0.2 | 0.2 | 0.2 | 0.2 | 0.2 |
| | Detergency rate (%) | | | | | | 21 | 26 | 26 | 27 | 16 | 19 | 18 | 16 | 12 | 12 | 12 | 10 | 10 |
| | Fluidity | | | | | | Good | Good | Good | Good | Poor | Poor | Poor | Poor | Good | Good | Good | Good | Good |

INDUSTRIAL APPLICABILITY

The detergent containing the surfactant (a) of the present invention has excellent detergency even when used in low concentration, exhibits excellent detergency even when containing an anionic surfactant which is widely used as a detergent, and is useful particularly for laundry detergents.

The invention claimed is:

1. A detergent comprising:

a surfactant (a) having a critical micelle concentration (CMC) of 0.10 g/L or lower, represented by formula (1):

$$R^1—[—O-(A^1O)_n—H]_2 \quad (1),$$

wherein $R^1$ is a C7-C20 hydrocarbon group having a valence number of 2; $A^1$ in $(A^1O)$ in each of $[—O-(A^1O)_n—H]_2$ is a combination of an ethylene group and at least one group selected from the group consisting of a 1,2-propylene group, a 1,2-butylene group, a 1,3-butylene group and a 2,3-butylene group; n in $[—O-(A^1O)_n—H]_2$ is each independently an integer of 1 to 100; and the sum of n in $[—O-(A^1O)_n—H]_2$ is 13 or greater; and a surfactant (b) represented by formula (2):

$$R^2—X-(A^2O)_p—H \quad (2)$$

wherein $R^2$ is a C10-C18 monovalent hydrocarbon group; X is —COO— or —O—; $A^2$ is each independently a C2-C4 alkylene group; and p is an integer of 1 to 30.

2. The detergent according to claim 1, wherein in the formula (1), at least one carbon atom in $R^1$ which is bonded to an oxygen atom in $[—O-(A^1O)_n—H]_2$ is a secondary carbon atom.

3. The detergent according to claim 1, wherein in the formula (1), $R^1$ is a C7-C20 alkylene group.

4. The detergent according to claim 1, wherein the CMC of the surfactant (a) is 0.08 g/L or lower.

* * * * *